US009734966B2

(12) United States Patent
Tsai et al.

(10) Patent No.: US 9,734,966 B2
(45) Date of Patent: Aug. 15, 2017

(54) MEMBRANE CIRCUIT BOARD AND LIGHT-EMITTING KEYBOARD USING THE SAME

(71) Applicant: CHICONY ELECTRONICS CO., LTD., New Taipei (TW)

(72) Inventors: Ching-Cheng Tsai, New Taipei (TW); Chia-Hsin Chen, New Taipei (TW)

(73) Assignee: CHICONY ELECTRONICS CO., LTD., New Taipei (TW)

( * ) Notice: Subject to any disclaimer, the term of this patent is extended or adjusted under 35 U.S.C. 154(b) by 168 days.

(21) Appl. No.: 14/745,952

(22) Filed: Jun. 22, 2015

(65) Prior Publication Data

US 2016/0172130 A1 Jun. 16, 2016

(30) Foreign Application Priority Data

Dec. 16, 2014 (TW) ..... 103143833 A

(51) Int. Cl.
*H01H 13/83* (2006.01)
*H01H 13/703* (2006.01)

(52) U.S. Cl.
CPC ..... *H01H 13/83* (2013.01); *H01H 13/703* (2013.01); *H01H 2219/036* (2013.01); *H01H 2219/062* (2013.01)

(58) Field of Classification Search
CPC ..... H01H 13/83; H01H 13/02; H03K 17/96; H03K 17/9622
USPC ..... 200/5 A
See application file for complete search history.

(56) References Cited

U.S. PATENT DOCUMENTS

2012/0048702 A1* 3/2012 Liu ..... H01H 3/125 200/5 A
2014/0166455 A1* 6/2014 Chen ..... H03K 17/98 200/5 A

* cited by examiner

*Primary Examiner* — Edwin A. Leon
*Assistant Examiner* — Iman Malakooti
(74) *Attorney, Agent, or Firm* — Chun-Ming Shih; HDLS IPR Services

(57) ABSTRACT

A light-emitting keyboard includes a membrane circuit board including a lower layer, an upper layer and a light-guiding spacer layer arranged between lower layer, an upper layer and defining therein a tapered through hole, a substrate holding membrane circuit board, a key assembly including key cap, a linkage coupled between key cap and substrate and an elastic element supported between key cap and membrane circuit board, and a light source for emitting light into the light-guiding spacer layer. The light-guiding spacer layer uses its thickness to isolate the lower layer and the upper layer and its tapered through hole to provide room for a triggering stroke for enabling the upper layer to electrically contact the lower layer second circuit in producing a corresponding switching signal each time the key assembly is pressed. Thus, the light-emitting keyboard achieves the characteristics of low profile, low manufacturing cost, and simple assembly process.

17 Claims, 7 Drawing Sheets

MEMBRANE CIRCUIT BOARD AND LIGHT-EMITTING KEYBOARD USING THE SAME

This application claims the priority benefit of Taiwan patent application number 103143833, filed on Dec. 16, 2014.

BACKGROUND OF THE INVENTION

1. Field of the Invention

The present invention relates to computer-input technologies and more particularly, to a membrane circuit board and a light-emitting keyboard using the membrane circuit board, wherein the membrane circuit board comprises a lower layer, an upper layer, and a light-guiding spacer layer arranged between the lower layer and the upper layer, and the light-guiding spacer layer is formed with a tapered through hole that provides room for a triggering stroke for enabling a second circuit of the upper layer to electrically connect to a first circuit of the lower layer and to further produce a corresponding switching signal when the membrane circuit board is triggered by a key assembly, and thus, the light-emitting keyboard has a low profile characteristic.

2. Description of the Related Art

In the era of technological we live today, electronic products bring people a convenient environment. However, most electronic products need an input device for data input, such as mouse, keyboard, joystick, light gun, etc. However, with the creation of advanced electronic products, keys and buttons for data input also need to be changed to fit different requirements. Most today's keyboards provide a light-emitting function.

FIG. 6 illustrates a keyboard design according to the prior art. According to this design, the keyboard comprises a substrate A, a light guide plate B, a membrane circuit board C, at least one key assembly D, and at least one light-emitting component E. The light guide plate B is mounted at the top side of the substrate A. The membrane circuit board C is supported on the top surface of the light guide plate B. The at least one key assembly D is supported on the membrane circuit board C, each comprising a key cap D1 and a transparent elastic element D2. The elastic element D2 is set between the key cap D1 and the membrane circuit board C. The light-emitting component E is mounted at one lateral side of the light guide plate B beneath the membrane circuit board C. Thus, the light emitted from the light-emitting component E can go into the inside of the light guide plate B and then be guided out or transmitted by the light guide plate B toward the transparent elastic element D2 and the key cap D1. The membrane circuit board C comprises an upper layer with a bottom-sided circuit, a lower layer with a top-sided circuit, and a spacer layer set between the upper layer and the lower layer to keep the upper layer and the lower layer vertically apart. The spacer layer has through holes. When one key assembly D is pressed, the upper layer of the membrane circuit board C is forced to deform elastically, causing a part of the bottom-sided circuit to protrude into one through hole of the spacer layer into contact with the top-sided circuit of the lower layer of the membrane circuit board C and produce a corresponding switching signal.

When assembling the aforesaid prior art keyboard, place the light guide plate B on the substrate A, and then electrically connect each light-emitting component E to the membrane circuit board C, and then mount the membrane circuit board C on the light guide plate B, and then mount the at least one key assembly D on the membrane circuit board C.

Further, it is the market trend to crease computers and related peripheral apparatuses that have light, thin, short and small characteristics. Thus, keyboards must be made having a low profile characteristic to satisfy specialized market requirements. However, the keyboard has been around for decades, and its technology is very mature. The internal structure of the keyboard has been very simplified. Under the situation that there is no groundbreaking material research performed, it is the primary goal of manufacturers to create a keyboard having a low profile characteristic while maintaining the desired functions and structure.

FIG. 7 illustrates a self-luminous circuit board that is capable of emitting light and practical for use in a keyboard. This self-luminous circuit board comprising a printed circuit board F and a circuit layer G. The circuit layer G is embedded in the printed circuit board F, comprising a circuit layout for conducting the printed circuit board F. The printed circuit board F comprises a top substrate F1 and a bottom substrate F2. The top substrate F1 and the bottom substrate F2 have different thicknesses. The circuit layout of the circuit layer G is arranged on the junction between the top substrate F1 and the bottom substrate F2. The bottom substrate F2 is relatively thicker. The bottom substrate F2 works as a light guide board and comprises a light emitting portion F22 for diffusing light uniformly, and a light source F21 mounted therein for emitting light laterally. The light emitting portion F22 is located in the top surface of the bottom substrate F2. The light source F21 is mounted inside the bottom substrate F2.

This prior art design has the light source F21 mounted in the printed circuit board F, eliminating the use of an extra light-guiding board, and thus, the thickness and number of components of the product can be minimized to facilitate the implementation of the assembly process. However, because the implementation of the circuit layout of the circuit layer G needs to apply a certain amount of silver paste to the top substrate F1 and bottom substrate F2 of the printed circuit board F. When applying silver paste to the top substrate F1 and bottom substrate F2, the top substrate F1 and the bottom substrate F2 can be eroded, causing edge chipping or generation of undesired holes in the top substrate F1 and the bottom substrate F2. Further, when the light emitted from the light source F21 goes into the inside of the bottom substrate F2, the silver paste lines can cause a severe light leakage problem, lowering the luminous performance of the product, or leading to a defected product.

Therefore, it is desirable to provide a keyboard, which eliminates the drawbacks of large thickness, complicated assembly procedure and high cost.

SUMMARY OF THE INVENTION

The present invention has been accomplished under the circumstances in view. It is therefore the main object of the present invention to provide a membrane circuit board and a light-emitting keyboard using the membrane circuit board, wherein the light-emitting keyboard comprises a substrate, the membrane circuit board, a key assembly, and a light source. The membrane circuit board is disposed on a top surface of the substrate, comprising a lower layer, an upper layer, and a light-guiding spacer layer arranged between the lower layer and the upper layer. The lower layer comprises a first circuit located in a top surface thereof. The upper layer comprises a second circuit located in a bottom surface thereof. The light-guiding spacer layer keeps the lower layer and the upper layer positioned apart from each other by a thickness thereof. The light-guiding spacer layer is formed with a through hole cut through opposing top and bottom surfaces thereof for enabling a corresponding portion of the upper layer to be elastically deformed by an external force to force the second circuit into contact with the first circuit of the lower layer. The key assembly is disposed on a top surface of the membrane circuit board and pressable to force a portion of the upper layer to enter the through hole of the light-guiding spacer layer to cause electric connection between the second circuit and the first circuit. The light source is adapted to emit light into the light-guiding spacer layer.

Subject to the features of the present invention that the light-guiding spacer layer utilizes its thickness to separate the lower layer and the upper layer and that each through hole of the light-guiding spacer layer provides room for a triggering stroke for enabling the upper layer to electrically connect the lower layer and to further produce a corresponding switching signal, the invention minimizes the number of layers of the light-emitting keyboard and provides the light-emitting keyboard with a low profile characteristic. Further, because the membrane circuit board is a one piece module that has the light-guiding spacer layer integrally built therein, the number of components of the product is minimized, saving much the manufacturing cost and assembly steps. Because the light-guiding spacer layer needs not to have a circuit formed thereon, the light-guiding spacer layer will not be eroded by silver paste, avoiding edge chipping or generation of undesired holes, and thus, the surface of the light-guiding spacer layer can be maintained in integrity to enhance the luminous performance of the product.

Preferably, the membrane circuit board further comprises a bump located at a bottom surface of the lower layer and supported on the substrate. The bump is arranged correspondingly to the through hole of the light-guiding spacer layer to lift a portion of the lower layer into the through hole of the light-guiding spacer layer. The lower layer curves upwards over the bump to shorten the distance between the top surface of the lifted portion of the lower layer and the bottom surface of the upper layer, enabling the second circuit of the upper layer to be accurately forced into contact with the first circuit of the lower layer upon each switching operation. Further, a gap is left between the substrate and the membrane circuit board around each bump for water drainage, preventing a short circuit damage.

Further, the substrate can be configured to provide at least one pair of hooks that are upwardly inserted through the membrane circuit board and disposed correspondingly to a key cap of the key assembly, and at least one frame member supported on the top surface of the membrane circuit board around an elastic element of the key assembly and fastened to the pair of hooks to secure a linkage of the key assembly. This arrangement greatly reduces the number of the hooks from the substrate and the number of the respective through holes from the membrane circuit board, minimizing the chance of light leakage and enhancing the luminous brightness.

Preferably, the membrane circuit board is configured to provide two bevel light guide edges at two opposite lateral sides thereof, preventing lateral light leakage.

Preferably, the through hole of the light-guiding spacer layer defines therein a tapered inner surface that reduces gradually in diameter in direction from the top surface of the light-guiding spacer layer to the opposing bottom surface thereof. The design of the tapered inner surface makes the area of the top side of the through hole relatively larger so that the deformable area of the upper layer is greatly increased and the second circuit of the upper layer can easily be forced into contact with the first circuit of the lower layer via the through hole of the light-guiding spacer layer when the upper layer is triggered, and the light that goes through the through hole can be widely projected out of the light-guiding spacer layer along the tapered inner surface of the through hole, increasing the range of light irradiation.

Other advantages and features of the present invention will be fully understood by reference to the following specification in conjunction with the accompanying drawings, in which like reference signs denote like components of structure.

DETAILED DESCRIPTION OF THE PREFERRED EMBODIMENT

Figure 1:
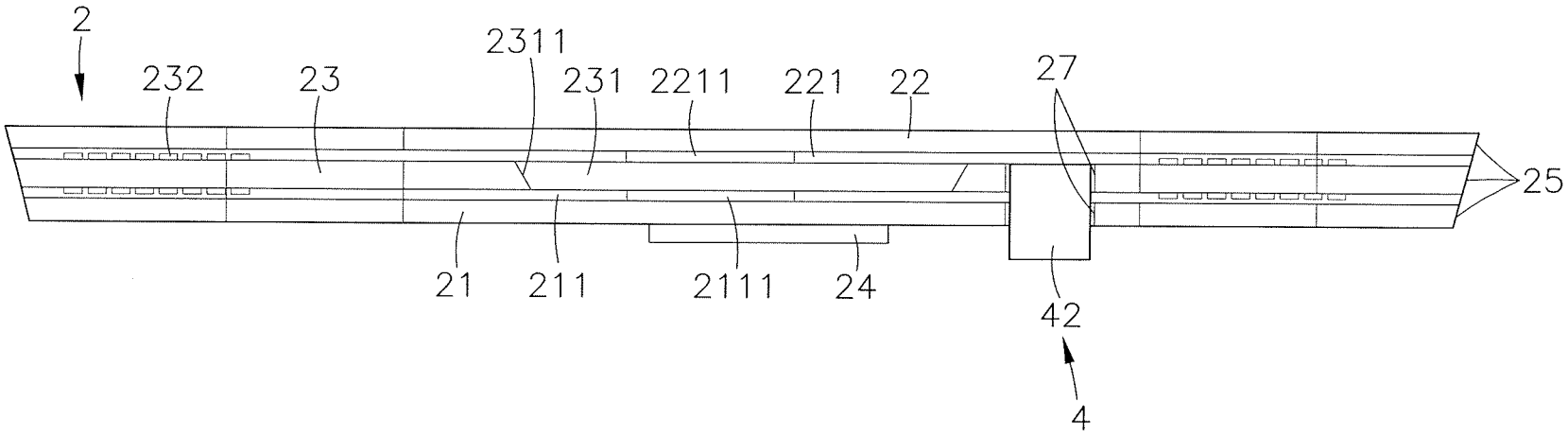
FIG. 1 is a schematic side view of a membrane circuit board in accordance with an embodiment of the present disclosure.
Figure 4:
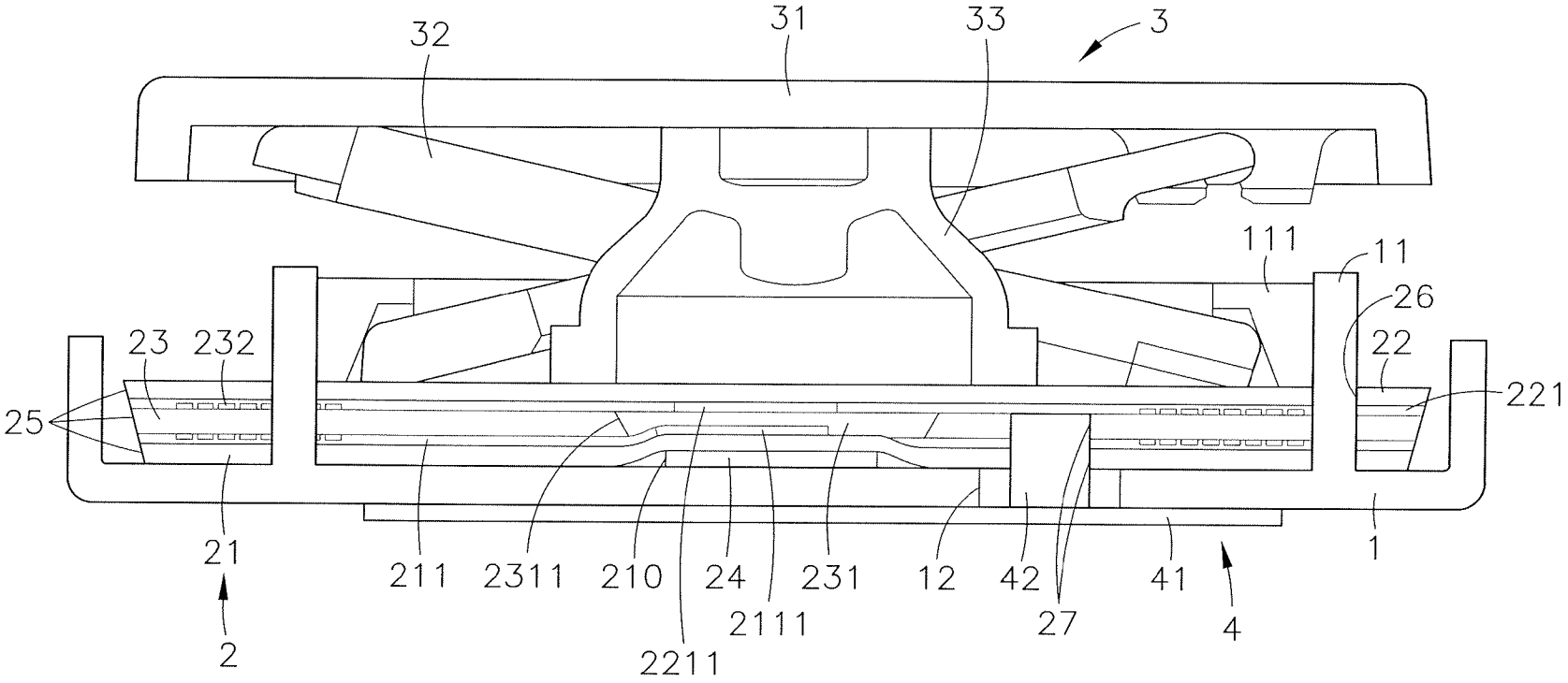
FIG. 4 is a sectional side view of the light-emitting keyboard in accordance with another embodiment of the present disclosure.

Referring to FIGS. 1 and 4, a membrane circuit board in accordance with an embodiment of the present disclosure is shown. The membrane circuit board 2 comprises a lower layer 21, an upper layer 22, and a light-guiding spacer layer 23 arranged between the lower layer 21 and the upper layer 22. The lower layer 21 comprises a first circuit 211 located on a top surface thereof. The upper layer 22 comprises a second circuit 221 located on a bottom surface thereof. The first circuit 211 comprises a plurality of first circuit contacts 2111. The second circuit 221 comprises a plurality of second circuit contacts 2211 respectively corresponding to the first circuit contacts 2111. The light-guiding spacer layer 23 is formed with at least one through hole 231 each corresponding to the respective first circuit contacts 2111 and the respective second circuit contacts 2211. When the upper layer 22 is not triggered, the light-guiding spacer layer 23 keeps the lower layer 21 and the upper layer 22 electrically isolated from each other. When the upper layer 22 is triggered, a corresponding portion of the upper layer 22 is elastically deformed to force respective second circuit contact 2211 into contact with respective first circuit contact 2111 via one respective through hole 231 of the light-guiding spacer layer 23, thereby producing a respective switching signal. According to the above structure, a light source 4 can be disposed proximal to the light-guiding spacer layer 23. The light-guiding spacer layer 23 receives the light emitted from the light source 4, and guides the incident light therethrough toward the outside in a predetermined direction. It is to be noted that, except the light guide function, the light-guiding spacer layer 23 is a part of the triggering stroke between the upper layer 22 and the lower layer 21. Compared to the prior art designs, the thin thickness of the light-guiding spacer layer 23 facilitates efficient application to achieve a low profile effect.

Figure 2:
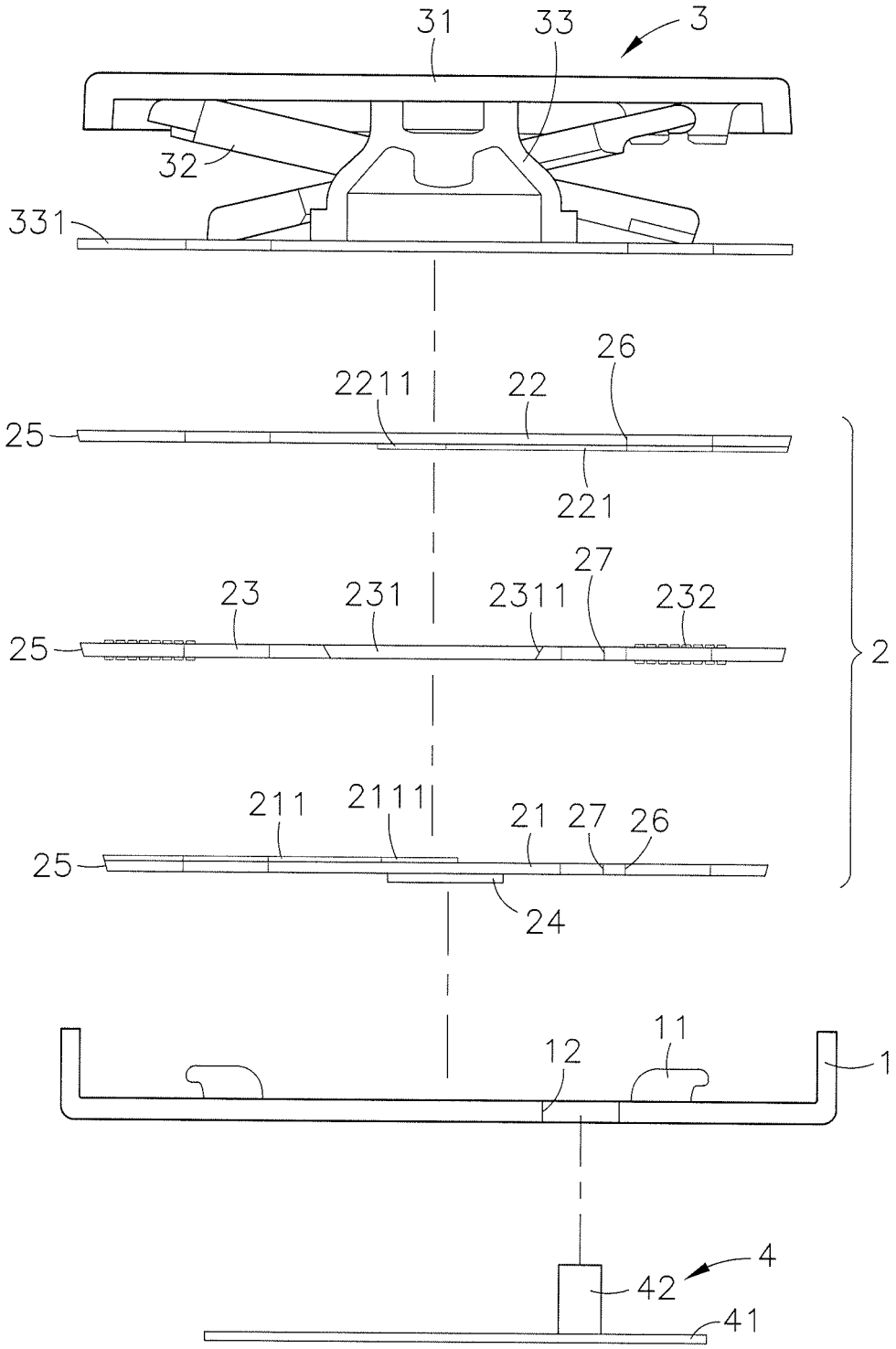
FIG. 2 is an exploded view, in section, of a light-emitting keyboard using the membrane circuit board in accordance with an embodiment of the present disclosure.
Figure 3:
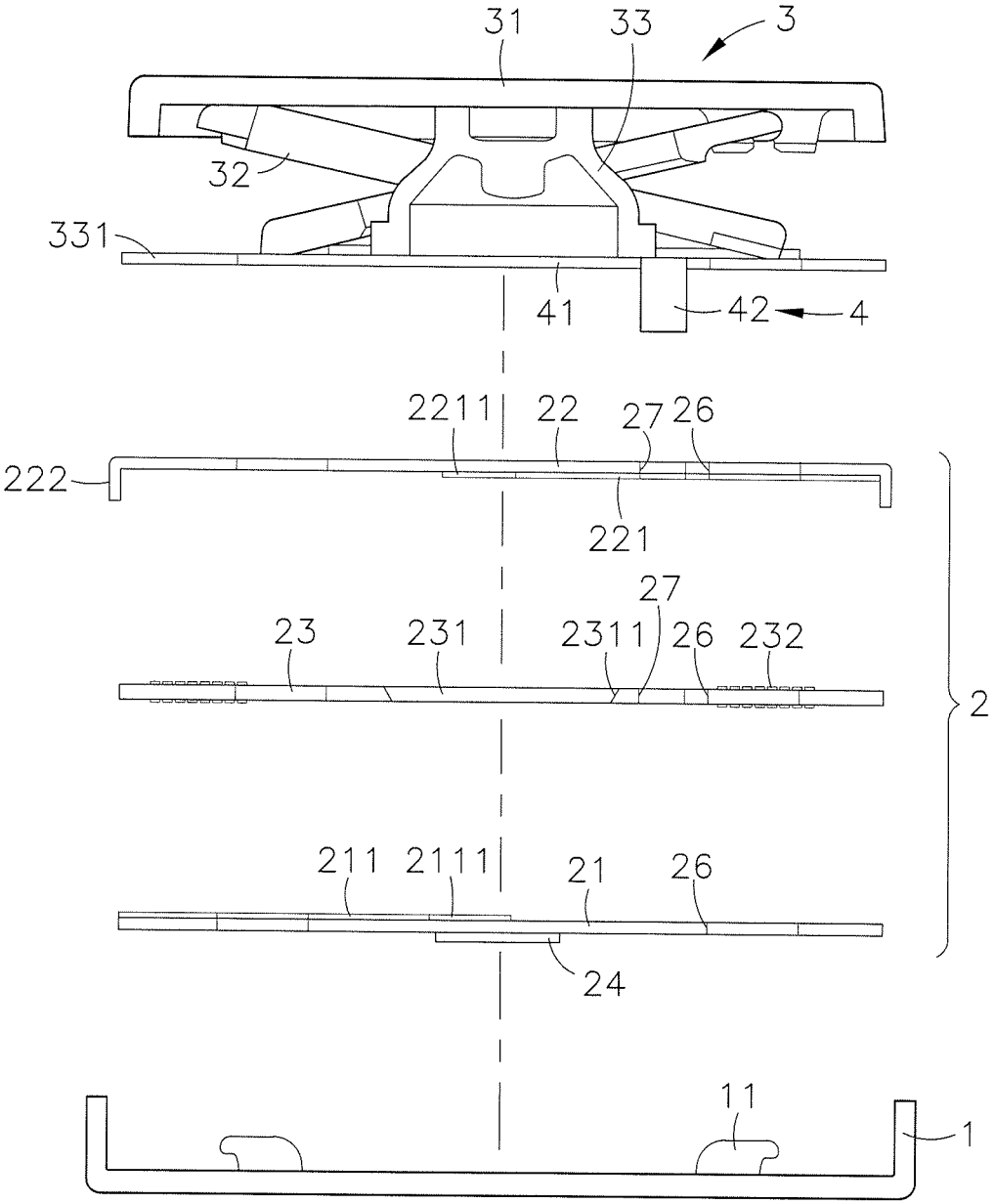
FIG. 3 is an exploded view, in section, of the light-emitting keyboard in accordance with another embodiment of the present disclosure.

In an alternate embodiment of the present disclosure, as shown in FIG. 3, the upper layer 22 of the membrane circuit board 2 is relatively larger than the lower layer 21 and the light-guiding spacer layer 23 in width (or length) and comprises two end flanges 222 respectively downwardly extending from two opposite lateral sides thereof and respectively covering two opposite lateral sides of the lower layer 21 and two opposite lateral sides of the light-guiding spacer layer 23. Further, the two end flanges 222 can be folded and closely attached to the bottom surface of the lower layer 21. Further, the two end flanges 222 can be configured to provide a light shielding structure or a light reflective structure. Further, as shown in FIGS. 1, 2 and 4, the membrane circuit board 2 can be configured to provide two opposite bevel light guide edges 25 respectively located at two opposite lateral sides thereof, preventing lateral light leakage.

Further, the through holes 231 of the light-guiding spacer layer 23 are tapered through holes each defining therein a tapered inner surface 2311 that reduces gradually in diameter in direction from the top surface of the light-guiding spacer layer 23 to the opposing bottom surface thereof. The design of the tapered inner surface 2311 makes the area of the top side of the respective through hole 231 relatively larger so that the deformable area of the upper layer 22 is greatly increased and, the second circuit contacts 2211 of the second circuit 221 of the upper layer 22 can easily be forced into contact with respective first circuit contacts 2111 of the first circuit 211 of the lower layer 21 via the respective through holes 231 of the light-guiding spacer layer 23 when the upper layer 22 is triggered. Further, the light that goes through the through holes 231 can be widely projected out of the light-guiding spacer layer 23 along the tapered inner surface 2311 of each through hole 231, increasing the range of light irradiation.

The light-guiding spacer layer 23 further comprises a light guide structure 232 located at the top surface and/or bottom surface thereof. The light guide structure 232 can be formed of a microstructure or ink. The light guide structure 232 that is located at the bottom surface of the light-guiding spacer layer 23 is configured to reflect light through the light-guiding spacer layer 23 in a predetermined direction, enhancing the luminous efficiency.

Referring to FIG. 1-4. The thickness of the light-guiding spacer layer 23 can be increased for enhancing the light guide performance. Therefore, the space between the lower layer 21 and the upper layer 22 may be relatively increased, while the downward displacement of the corresponding portion of the upper layer 22 may be limited when the upper layer 22 is triggered and elastically deformed, causing the second circuit 221 of the upper layer 22 unable to touch the first circuit 211 of the lower layer 21. In order to eliminate this problem, the membrane circuit board 2 is configured to provide bumps 24 at the bottom surface of the lower layer 21 corresponding to the through holes 231 of the light-guiding spacer layer 23. Using the bumps 24 to lift the lower layer 21, the lower layer 21 can be partially projected into the through holes 231 to shorten the triggering stroke between the upper layer 22 and the lower layer 21, and thus, the second circuit contacts 2211 of the second circuit 221 of the upper layer 22 can easily be forced into contact with respective first circuit contacts 2111 of the first circuit 211 of the lower layer 21 via the respective through holes 231 of the light-guiding spacer layer 23 when the upper layer 22 is triggered.

According to the present disclosure, the light-guiding spacer layer 23 utilizes its thickness to separate the lower layer 21 and the upper layer 22; the through holes 231 of the light-guiding spacer layer 23 provide room for a triggering stroke for enabling the second circuit 221 to contact the first circuit 211 and to further produce a corresponding switching signal. The light-guiding spacer layer 23 is formed in the membrane circuit board 2 between the lower layer 21 and the upper layer 22, minimizing the number of layers of the product and providing the product with a low profile characteristic. Further, the number of the hooks 11 of the substrate 1 and the number of the respective through holes 26 of the membrane circuit board 2 are greatly reduced and, because the membrane circuit board 2 is a one piece module that has the light-guiding spacer layer 23 integrally built therein, the number of components of the product is minimized, saving much the manufacturing cost and assembly steps. Further, because the light-guiding spacer layer 23 needs not to have a circuit formed therein, the light-guiding spacer layer 23 will not be eroded by silver paste, avoiding edge chipping or generation of undesired holes, and thus, the surface of the light-guiding spacer layer 23 can be maintained in integrity to enhance the luminous performance of the product.

Referring to FIGS. 2-5, a light-emitting keyboard using the above-described membrane circuit board in accordance with the present disclosure is shown. The light-emitting keyboard comprises a substrate 1, a membrane circuit board 2, at least one key assembly 3 and a light source 4.

The substrate 1 is made from a hard material (such as metal or hard plastic material), and adapted to carry the membrane circuit board 2 and the at least one key assembly 3.

The structure of the membrane circuit board 2 is as stated above, no repeated description in this regard is necessary. In this embodiment, the membrane circuit board 2 is mounted at the top surface of the substrate 1; the at least one key assembly 3 is supported on the top surface of the membrane circuit board 2. Each key assembly 3 comprises a cap 31, a linkage 32 and an elastic element 33. The linkage 32 is coupled between the key cap 31 and the substrate 1. In this embodiment, the linkage 32 is a scissors mechanism. Alternatively, the linkage 32 can be a V-shaped linkage or parallel linkage. The elastic element 33 is disposed between the key cap 31 and the membrane circuit board 2. The elastic element 33 is elastically deformed to trigger the membrane circuit board 2 and to preserve elastic potential energy when the key cap 31 is pressed by an external force. After the external force is disappeared, the elastic element 33 releases its elastic potential energy to move the key cap 31 and the linkage 32 back to their former position.

The light source 4 is disposed proximal to the light-guiding spacer layer 23, and adapted to emit light into the light-guiding spacer layer 23.

When a user uses the light-emitting keyboard and presses the key cap 31 of one key assembly 3, the key cap 31 is forced to move the linkage 32 downward and to further elastically compress the associating elastic element 33 against the membrane circuit board 2, causing the corresponding portion of the upper layer 22 to curve downward elastically. At this time, the second circuit 221 of the upper layer 22 is forced to partially move into the respective through hole 231 of the light-guiding spacer layer 23 to further contact the first circuit 211 of the lower layer 21, thereby producing a respective switching signal. When the applied external force is released from the key cap 31, the elastic element 33 immediately returns to its former shape to move the key cap 31 and the linkage 32 back to their former initial position, thereby restoring the upper layer 22 to its original shape, and thus the second circuit 221 and the first circuit 211 are electrically disconnected, and the single switching stroke of the key assembly 3 is completed. Further, the light emitted by the light source 4 falls upon the light-guiding spacer layer 23 and is then guided by the light-guiding spacer layer 23 and then radiated onto the key cap 31 to illuminate the key cap 31.

Based on the technical features of the present invention that the light-guiding spacer layer 23 uses its thickness to separate the lower layer 21 and the upper layer 22 and the through holes 231 of the light-guiding spacer layer 23 provide room for the triggering stroke for enabling the second circuit 221 to contact the first circuit 211 and to further produce a corresponding switching signal and that the light-guiding spacer layer 23 is arranged in the membrane circuit board 2 between the lower layer 21 and the upper layer 22, the invention minimizes the number of layers of the light-emitting keyboard and provides the product with a low profile characteristic. Further, because the membrane circuit board 2 is a one piece module that has the light-guiding spacer layer 23 integrally built therein, the number of components of the light-emitting keyboard is minimized, saving much the manufacturing cost and assembly steps. Further, because the light-guiding spacer layer 23 needs not to have a circuit formed therein, the light-guiding spacer layer 23 will not be eroded by silver paste, avoiding edge chipping or generation of undesired holes, and thus, the surface of the light-guiding spacer layer 23 can be maintained in integrity to enhance the luminous performance of the product.

Figure 5:
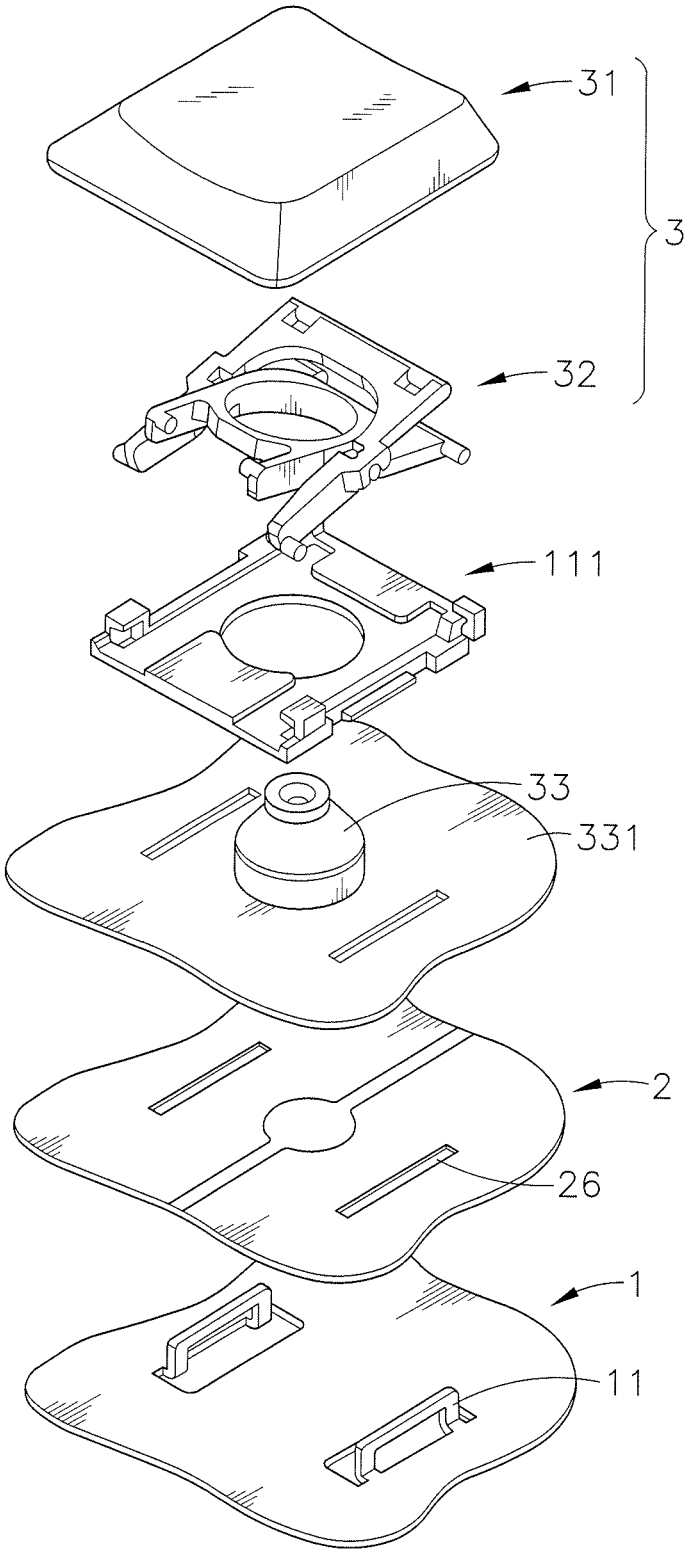
FIG. 5 is an exploded view of the light-emitting keyboard in accordance with FIG. 4.
Figure 6:
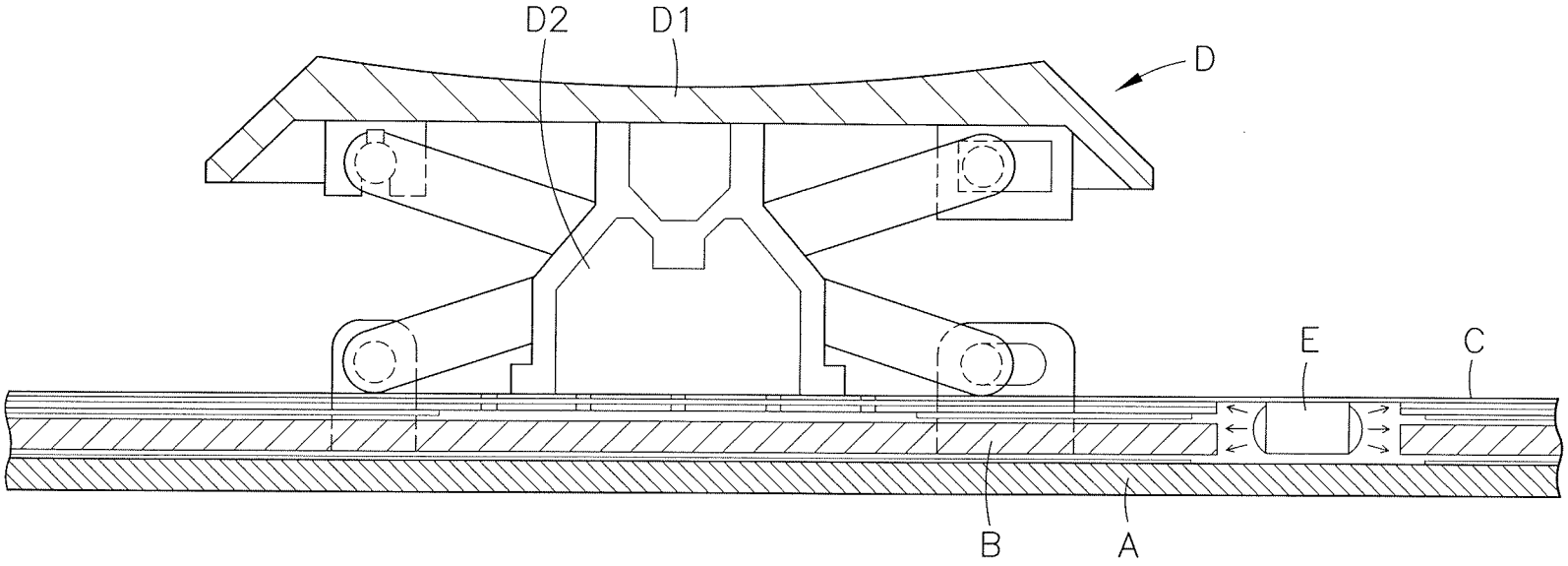
PRIOR ART FIG. 6
FIG. 6 is a sectional side view of a key switch structure according to the prior art.
Figure 7:
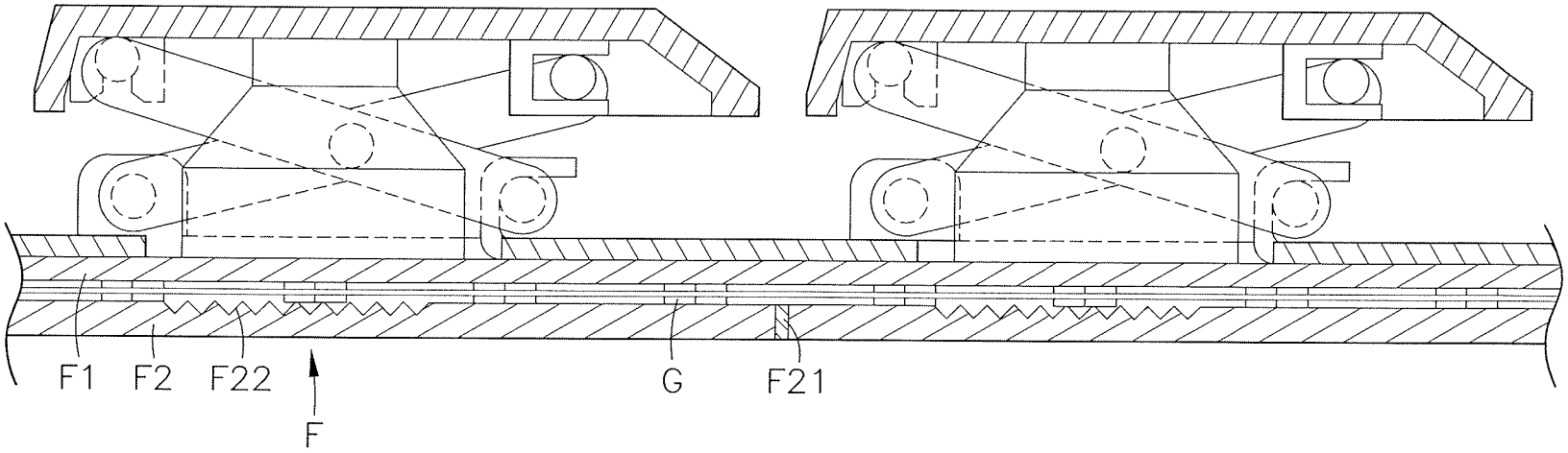
PRIOR ART FIG. 7
FIG. 7 is a sectional side view of another design of key switch structure according to the prior art.

Referring to FIGS. 2 and 3 again, the substrate 1 can be configured to provide at least one set of hooks 11 respectively inserted through respective through holes 26 in the membrane circuit board 2 and respectively disposed corresponding to the key cap 31 of each key assembly 3 for securing the linkage 32 of each key assembly 3, wherein each set of hooks 11 includes four hooks 11 respectively disposed in four corners. Alternatively, as shown in FIGS. 4 and 5, the substrate 1 can be configured to provide at least one pair of hooks 11 upwardly inserted through the membrane circuit board 2 and respectively disposed corresponding to the key cap 31 of each respective key assembly 3, and at least one frame member 111 supported on the top surface of the membrane circuit board 2 around the elastic element 33 of each respective key assembly 3 and fastened to each respective pair of hooks 11 to secure the linkage 32 of each respective key assembly 3. This alternate form greatly reduces the number of the hooks 11 from the substrate 1 and the number of the respective through holes 26 from the membrane circuit board 2. Further, the hooks 11 of the substrate 1 are respectively upwardly inserted through respective through holes 26 in the membrane circuit board 2. The arrangement of the through holes 26 in the membrane circuit board 2 can cause leakage of light. Mounting the at least one frame member 111 on the membrane circuit board 2 around the elastic element 33 of each key assembly 3 and then fastening the at least one frame member 111 to the at least one pair of hooks 11 for securing the linkage 32 of each respective key assembly 3 to the substrate 1 can prevent leakage of light through the through holes 26, enhancing the luminous efficiency.

In the embodiment shown in FIGS. 2 and 4, the substrate 1 is configured to provide at least one insertion holes 12 cut through opposing top and bottom surfaces thereof; the light source 4 comprises a printed circuit board 41 mounted at a bottom side relative to the substrate 1, and at least one light-emitting component 42 located at a top side of the printed circuit board 41 and respectively upwardly inserted through the at least one insertion hole 12 of the substrate 1 into respective through holes 27 in the membrane circuit board 2. In the embodiment shown in FIG. 3, the light source 4 comprises a printed circuit board 41 mounted at the bottom side of each key assembly 3 and supported on the top surface of the membrane circuit board 2, and at least one light-emitting component 42 located at a bottom side of the printed circuit board 41 and respectively downwardly inserted through one respective hole in the upper layer 22 and light-guiding spacer layer 23 of the membrane circuit board 2. Further, the light source 4 can also be made comprising at least one light-emitting component 42 mounted in a respective mounting hole (not shown) in the light-guiding spacer layer 23 of the membrane circuit board 2 and electrically connected to the first circuit 211 of the lower layer 21 or the second circuit 221 of the upper layer 22.

Referring to FIGS. 2-4 again, the elastic element 33 of each key assembly 3 can be directly mounted on the top surface of the upper layer 22 of the membrane circuit board 2. Alternatively, the elastic element 33 of each key assembly 3 can be integrally formed in a thin film 331. The thin film 331 can be directly covering on the top surface of the membrane circuit board 2. Conventional configuration of elastic element well known to those skilled in the art may be employed to form the key assembly 3 and the instant disclosure is not limited thereto. No further detailed description in this regard will be necessary.

In conclusion, the disclosure provides a membrane circuit board and a light-emitting keyboard using the membrane circuit board. In application, the membrane circuit board and the light-emitting keyboard according to the embodiment have the advantages and features as follows:

1. Subject to the features of the present disclosure that the light-guiding spacer layer 23 uses its thickness to separate the lower layer 21 and the upper layer 22 and that the through holes 231 of the light-guiding spacer layer 23 provide room for a triggering stroke for enabling the second circuit 221 to contact the first circuit 211 and to further produce a corresponding switching signal, minimizes the number of layers of the light-emitting keyboard can be minimized and a light-emitting keyboard with a low profile characteristic is provided. Further, because the membrane circuit board 2 is a one piece module that has the light-guiding spacer layer 23 integrally built therein, the number of components of the product is minimized, saving much the manufacturing cost and assembly steps; because the light-guiding spacer layer 23 needs not to have a circuit formed therein, the light-guiding spacer layer 23 will not be eroded by silver paste, avoiding edge chipping or generation of undesired holes, and thus, the surface of the light-guiding spacer layer 23 can be maintained in integrity to enhance the luminous performance of the product.
2. In an alternative embodiment, the lower layer 21 curves upwards over each bump 24 to shorten the distance between the top surface of the lower layer 21 and the bottom surface of the upper layer 22 corresponding to each bump 24, enabling the second circuit 221 of the upper layer 22 to be accurately forced into contact with the first circuit 211 of the lower layer 21 upon each switching operation; a gap 210 is left between the substrate 1 and the membrane circuit board 2 around each bump 24 for water drainage, preventing a short circuit damage.

3. The substrate 1 can be configured to provide at least one pair of hooks 11 that are upwardly inserted through the membrane circuit board 2 and respectively disposed corresponding to the key cap 31 of each respective key assembly 3, and at least one frame member 111 supported on the top surface of the membrane circuit board 2 around the elastic element 33 of each respective key assembly 3 and fastened to each respective pair of hooks 11 to secure the linkage 32 of each respective key assembly 3; this embodiment greatly reduces the number of the hooks 11 from the substrate 1 and the number of the respective through holes 26 from the membrane circuit board 2, minimizing the chance of light leakage and enhancing the luminous brightness.

4. The membrane circuit board 2 can be configured to provide two bevel light guide edges 25 at two opposite lateral sides thereof, preventing lateral light leakage.

5. Each through hole 231 of the light-guiding spacer layer 23 defines therein a tapered inner surface 2311 that reduces gradually in diameter in direction from the top surface of the light-guiding spacer layer 23 to the opposing bottom surface thereof; the design of the tapered inner surface 2311 makes the area of the top side of the respective through hole 231 relatively larger so that the deformable area of the upper layer 22 is greatly increased and the second circuit contacts 2211 of the second circuit 221 of the upper layer 22 can easily be forced into contact with respective first circuit contacts 2111 of the first circuit 211 of the lower layer 21 via the respective through holes 231 of the light-guiding spacer layer 23 when the upper layer 22 is triggered, and, the light that goes through the through holes 231 can be widely projected out of the light-guiding spacer layer 23 along the tapered inner surface 2311 of each through hole 231, increasing the range of light irradiation.

Although particular embodiments of the invention have been described in detail for purposes of illustration, various modifications and enhancements may be made without departing from the spirit and scope of the invention. Accordingly, the invention is not to be limited except as by the appended claims.

What the invention claimed is:

1. A light-emitting keyboard, comprising:

a substrate;

a membrane circuit board disposed on a top surface of said substrate, said membrane circuit board comprising a lower layer, an upper layer and a light-guiding spacer layer arranged between said lower layer and said upper layer, said lower layer comprising a first circuit located on a top surface thereof, said upper layer comprising a second circuit located on a bottom surface thereof, said light-guiding spacer layer keeping said lower layer and said upper layer positioned apart from each other by a thickness thereof, wherein said light-guiding spacer layer is formed with a through hole cut through opposing top and bottom surfaces thereof for allowing a corresponding portion of said upper layer to be elastically deformed by an external force to force said second circuit into contact with said first circuit;

a key assembly disposed on a top surface of said membrane circuit board and pressable to force the corresponding portion of said upper layer to enter said through hole to cause electric connection between said second circuit and said first circuit; and a light source adapted to emit light into said light-guiding spacer layer, wherein said membrane circuit board further comprises a bump located at a bottom surface of said lower layer and supported on said substrate, and said bump is arranged correspondingly to said through hole of said light-guiding spacer layer to lift a portion of said lower layer into said through hole of said light-guiding spacer layer.

2. A light-emitting keyboard, comprising:

a substrate;

a membrane circuit board disposed on a top surface of said substrate, said membrane circuit board comprising a lower layer, an upper layer and a light-guiding spacer layer arranged between said lower layer and said upper layer, said lower layer comprising a first circuit located on a top surface thereof, said upper layer comprising a second circuit located on a bottom surface thereof, said light-guiding spacer layer keeping said lower layer and said upper layer positioned apart from each other by a thickness thereof, wherein said light-guiding spacer layer is formed with a through hole cut through opposing top and bottom surfaces thereof for allowing a corresponding portion of said upper layer to be elastically deformed by an external force to force said second circuit into contact with said first circuit;

a key assembly disposed on a top surface of said membrane circuit board and pressable to force the corresponding portion of said upper layer to enter said through hole to cause electric connection between said second circuit and said first circuit; and a light source adapted to emit light into said light-guiding spacer layer, wherein said substrate comprises at least one insertion hole, said light source comprises a printed circuit board and at least one light-emitting component, said printed circuit board is mounted at a bottom side of said substrate, and said at least one light-emitting component is electrically installed in said printed circuit board and respectively inserted through said at least one insertion hole of said substrate into said lower layer and said light-guiding spacer layer of said membrane circuit board.

3. A light-emitting keyboard, comprising:

a substrate;

a membrane circuit board disposed on a top surface of said substrate, said membrane circuit board comprising a lower layer, an upper layer and a light-guiding spacer layer arranged between said lower layer and said upper layer, said lower layer comprising a first circuit located on a top surface thereof, said upper layer comprising a second circuit located on a bottom surface thereof, said light-guiding spacer layer keeping said lower layer and said upper layer positioned apart from each other by a thickness thereof, wherein said light-guiding spacer layer is formed with a through hole cut through opposing top and bottom surfaces thereof for allowing a corresponding portion of said upper layer to be elastically deformed by an external force to force said second circuit into contact with said first circuit;

a key assembly disposed on a top surface of said membrane circuit board and pressable to force the corresponding portion of said upper layer to enter said through hole to cause electric connection between said second circuit and said first circuit; and a light source adapted to emit light into said light-guiding spacer layer, wherein said light source comprises a printed circuit board and at least one light-emitting component, said printed circuit board is disposed on the top surface of said membrane circuit board, and said at least one light-emitting component is electrically installed at a bottom side of said printed circuit board and respectively downwardly inserted through one respective hole in said upper layer and said light-guiding spacer layer of said membrane circuit board.

4. A light-emitting keyboard, comprising:

a substrate;

a membrane circuit board disposed on a top surface of said substrate, said membrane circuit board comprising a lower layer, an upper layer and a light-guiding spacer layer arranged between said lower layer and said upper layer, said lower layer comprising a first circuit located on a top surface thereof, said upper layer comprising a second circuit located on a bottom surface thereof, said light-guiding spacer layer keeping said lower layer and said upper layer positioned apart from each other by a thickness thereof, wherein said light-guiding spacer layer is formed with a through hole cut through opposing top and bottom surfaces thereof for allowing a corresponding portion of said upper layer to be elastically deformed by an external force to force said second circuit into contact with said first circuit;

a key assembly disposed on a top surface of said membrane circuit board and pressable to force the corresponding portion of said upper layer to enter said through hole to cause electric connection between said second circuit and said first circuit; and a light source adapted to emit light into said light-guiding spacer layer, wherein said membrane circuit board comprises two bevel light guide edges respectively located at two opposite lateral sides thereof and sloping downwardly inwards.

5. A light-emitting keyboard, comprising:

a substrate;

a membrane circuit board disposed on a top surface of said substrate, said membrane circuit board comprising a lower layer, an upper layer and a light-guiding spacer layer arranged between said lower layer and said upper layer, said lower layer comprising a first circuit located on a top surface thereof, said upper layer comprising a second circuit located on a bottom surface thereof, said light-guiding spacer layer keeping said lower layer and said upper layer positioned apart from each other by a thickness thereof, wherein said light-guiding spacer layer is formed with a through hole cut through opposing top and bottom surfaces thereof for allowing a corresponding portion of said upper layer to be elastically deformed by an external force to force said second circuit into contact with said first circuit;

a key assembly disposed on a top surface of said membrane circuit board and pressable to force the corresponding portion of said upper layer to enter said through hole to cause electric connection between said second circuit and said first circuit; and a light source adapted to emit light into said light-guiding spacer layer, wherein said through hole of said light-guiding spacer layer is a tapered through hole defining therein a tapered inner surface that reduces gradually in diameter in direction from the top surface of said light-guiding spacer layer to the opposing bottom surface thereof.

6. A light-emitting keyboard, comprising:

a substrate;

a membrane circuit board disposed on a top surface of said substrate, said membrane circuit board comprising a lower layer, an upper layer and a light-guiding spacer layer arranged between said lower layer and said upper layer, said lower layer comprising a first circuit located on a top surface thereof, said upper layer comprising a second circuit located on a bottom surface thereof, said light-guiding spacer layer keeping said lower layer and said upper layer positioned apart from each other by a thickness thereof, wherein said light-guiding spacer layer is formed with a through hole cut through opposing top and bottom surfaces thereof for allowing a corresponding portion of said upper layer to be elastically deformed by an external force to force said second circuit into contact with said first circuit;

a key assembly disposed on a top surface of said membrane circuit board and pressable to force the corresponding portion of said upper layer to enter said through hole to cause electric connection between said second circuit and said first circuit; and a light source adapted to emit light into said light-guiding spacer layer, wherein said light-guiding spacer layer comprises a light guide structure located at one of the opposing top and bottom surfaces thereof.

7. A light-emitting keyboard, comprising:

a substrate;

a membrane circuit board disposed on a top surface of said substrate, said membrane circuit board comprising a lower layer, an upper layer and a light-guiding spacer layer arranged between said lower layer and said upper layer, said lower layer comprising a first circuit located on a top surface thereof, said upper layer comprising a second circuit located on a bottom surface thereof, said light-guiding spacer layer keeping said lower layer and said upper layer positioned apart from each other by a thickness thereof, wherein said light-guiding spacer layer is formed with a through hole cut through opposing top and bottom surfaces thereof for allowing a corresponding portion of said upper layer to be elastically deformed by an external force to force said second circuit into contact with said first circuit;

a key assembly disposed on a top surface of said membrane circuit board and pressable to force the corresponding portion of said upper layer to enter said through hole to cause electric connection between said second circuit and said first circuit; and a light source adapted to emit light into said light-guiding spacer layer, wherein said upper layer comprises two end flanges extending from two opposite lateral sides thereof and respectively covering two opposite lateral sides of said lower layer and two opposite lateral sides of said light-guiding spacer layer.

8. The membrane circuit board as claimed in claim 7, wherein said two end flanges is configured to be folded and closely attached to a bottom surface of said lower layer.

9. A membrane circuit board, comprising a lower layer, an upper layer, and a light-guiding spacer layer arranged between said lower layer and said upper layer, wherein said lower layer comprises a first circuit located on a top surface thereof; said upper layer comprises a second circuit located on a bottom surface thereof; said light-guiding spacer layer utilizes the thickness thereof to separate said lower layer and said upper layer, and said light-guiding spacer layer is formed with a through hole cut through opposing top and bottom surfaces thereof for allowing a corresponding portion of said upper layer to be elastically deformed by an external force to force said second circuit into contact with said first circuit; and a bump located at a bottom surface of said lower layer arranged correspondingly to said through hole of said light-guiding spacer layer and adapted to lift a portion of said lower layer into said through hole of said light-guiding spacer layer.

10. A membrane circuit board, comprising a lower layer, an upper layer, and a light-guiding spacer layer arranged between said lower layer and said upper layer, wherein said lower layer comprises a first circuit located on a top surface thereof; said upper layer comprises a second circuit located on a bottom surface thereof; said light-guiding spacer layer utilizes the thickness thereof to separate said lower layer and said upper layer, and said light-guiding spacer layer is formed with a through hole cut through opposing top and bottom surfaces thereof for allowing a corresponding portion of said upper layer to be elastically deformed by an external force to force said second circuit into contact with said first circuit; and two bevel light guide edges sloping downwardly inwards and respectively located at two opposite lateral sides thereof.

11. A membrane circuit board, comprising a lower layer, an upper layer, and a light-guiding spacer layer arranged between said lower layer and said upper layer, wherein said lower layer comprises a first circuit located on a top surface thereof; said upper layer comprises a second circuit located on a bottom surface thereof; said light-guiding spacer layer utilizes the thickness thereof to separate said lower layer and said upper layer, and said light-guiding spacer layer is formed with a through hole cut through opposing top and bottom surfaces thereof for allowing a corresponding portion of said upper layer to be elastically deformed by an external force to force said second circuit into contact with said first circuit; wherein said through hole of said light-guiding spacer layer is a tapered through hole defining therein a tapered inner surface that reduces gradually in diameter in direction from the top surface of said light-guiding spacer layer to the opposing bottom surface thereof.

12. A membrane circuit board, comprising a lower layer, an upper layer, and a light-guiding spacer layer arranged between said lower layer and said upper layer, wherein said lower layer comprises a first circuit located on a top surface thereof; said upper layer comprises a second circuit located on a bottom surface thereof; said light-guiding spacer layer utilizes the thickness thereof to separate said lower layer and said upper layer, and said light-guiding spacer layer is formed with a through hole cut through opposing top and bottom surfaces thereof for allowing a corresponding portion of said upper layer to be elastically deformed by an external force to force said second circuit into contact with said first circuit; wherein said light-guiding spacer layer comprises a light guide structure located at one of the opposing top and bottom surfaces thereof.

13. A membrane circuit board, comprising a lower layer, an upper layer, and a light-guiding spacer layer arranged between said lower layer and said upper layer, wherein said lower layer comprises a first circuit located on a top surface thereof; said upper layer comprises a second circuit located on a bottom surface thereof; said light-guiding spacer layer utilizes the thickness thereof to separate said lower layer and said upper layer, and said light-guiding spacer layer is formed with a through hole cut through opposing top and bottom surfaces thereof for allowing a corresponding portion of said upper layer to be elastically deformed by an external force to force said second circuit into contact with said first circuit; wherein said upper layer comprises two end flanges extending from two opposite lateral sides thereof and respectively covering two opposite lateral sides of said lower layer and two opposite lateral sides of said light-guiding spacer layer.

14. The membrane circuit board as claimed in claim 13, wherein said two end flanges is configured to be folded and closely attached to a bottom surface of said lower layer.

15. The light-emitting keyboard as claimed in claim 6, wherein said key assembly comprises a key cap, an elastic element, and a linkage, said key cap is suspending above said membrane circuit board, said elastic element is disposed on a top surface of said upper layer and arranged correspondingly to said through hole of said light-guiding spacer layer, and said linkage is coupled between said key cap and said substrate.

16. The light-emitting keyboard as claimed in claim 15, wherein said substrate comprises four hooks respectively corresponding to four corners of said key cap for the coupling of said linkage of said key assembly.

17. The light-emitting keyboard as claimed in claim 15, wherein said substrate comprises a pair of hooks and a frame member, the hooks are upwardly inserted through said membrane circuit board, and the frame member is supported on said membrane circuit board and coupled between said hooks and said linkage of said key assembly.

* * * * *